US005524866A

United States Patent [19]

Taylor

[11] Patent Number: 5,524,866

[45] Date of Patent: Jun. 11, 1996

[54] STAPLE REMOVER

[76] Inventor: James Taylor, P.O. Box 13742, San Antonio, Tex. 78213

[21] Appl. No.: 351,766

[22] Filed: Dec. 8, 1994

[51] Int. Cl.[6] ..... B25C 11/00

[52] U.S. Cl. ..... 254/28

[58] Field of Search ..... 254/28; 227/63

[56] References Cited

U.S. PATENT DOCUMENTS

| | | | |
|---|---|---|---|
| 2,215,662 | 9/1940 | De Generes | 254/28 |
| 2,356,693 | 8/1944 | Polzer | 254/28 |
| 2,481,647 | 9/1949 | De Generes | 254/28 |
| 2,518,485 | 8/1950 | Maynard | 254/28 |
| 2,567,021 | 9/1951 | Maynard | 254/28 |

FOREIGN PATENT DOCUMENTS

| | | | |
|---|---|---|---|
| WO92/17320 | 10/1992 | European Pat. Off. | 254/28 |

*Primary Examiner*—Robert C. Watson
*Attorney, Agent, or Firm*—David G. Henry

[57] ABSTRACT

The invention is of an improved staple removing and retaining apparatus. The remover has a two-part pry-bar type removing member, both members of which initially are inserted below the cross-member of an installed staple, but a part of which then, upon actuation of the remover, lifts the staple from paper level. The removed staple is trapped in a magnetized trap compartment. The paper is not damaged because the non-moving component of the pry-bar assembly remains flush with the paper, prevents any distractive force being applied thereto, and deforms the staple cusps during removal to travel solely through the originally formed holes in the paper. Applicant's remover eases staple removal, prevents paper damage, and contains removed staples which might otherwise fall into and damage expensive computer and photocopy equipment.

3 Claims, 2 Drawing Sheets

STAPLE REMOVER

BACKGROUND OF THE INVENTION

1. Field of The Invention

Applicant's invention relates to the removal of staples from paper and other planer materials to which staples have been applied.

2. Background Information

Improved methods of and apparatuses for the efficient removal of staples are driven by market demands for such improvements. Anyone exposed to any office environment has experienced the frustration while attempting to remove a staple of tearing up a document, breaking a fingernail, and/or grappling with the staple before succesfully removing it. These problems have existed since staples were first introduced.

The drive for ever more effective and efficient ways to remove staples comes from two primary but unrelated factors—(1) the accelerated pace of modern office environments where delays in any repeated procedure is viewed as an unacceptable inefficiency; and (2) the danger to expensive computer, fax, and photocopy machinery posed by the occasionally dropped staple.

Easily the most common form of staple remover in contemporary office environments are those which are generally of the configuration shown in Augustin, Des. U.S. Pat. No. 281,662. Improvements to this type of staple remover are taught in the following U.S. Pat. Nos.:

| | |
|---|---|
| Delia | 4,054,263 |
| Clark | 5,284,322 |
| Webster | 5,246,449 |
| Koo | 5,195,724 |

However, none of these improvements change the basic manner in which staples are grasped and removed from paper. The removers are designed to draw a staple from one or more sheets of paper by action of opposing, sharp-tipped prongs which reciprocate in a scissor-like action to reach under a staple and draw it from the paper. One problem with staple removers of this type is that the sharp prongs often gouge and damage the paper. Another problem is that the removers, even those which have magnetized components for retaining removed staples, do not reliably do so.

Further still, some users of the Augustin-type staple removers, particularly those suffering from arthritis, carpel tunnel syndrome, etc. may find operation thereof difficult or painful. It is a well known fact that persons who have less than optimal dexterity or otherwise debilitating conditions of the hands perform better and with less discomfort when faced with gross rather than small precise motion requirements (the latter being required while using Augustin-type removers).

SUMMARY OF THE INVENTION

It is an object of the present invention to provide a novel and unobvious staple remover.

It is another object of the present invention to provide a novel and unobvious staple remover which removes staples from paper(s), but does not use claw-like prongs which can damage the paper(s).

It is another object of the present invention to provide a novel and unobvious staple remover which effectively collects and stores removed staples as they are removed.

It is another object of the present invention to provide a novel and unobvious staple remover which is both easier to operate than presently available staple removers, yet is equally effective with the most effective presently available removers in removing staples and effectively traps and stores staples as they are removed.

In satisfaction of these and related objectives, Applicant's present invention provides a new design for a staple remover and removed staple trap.

Applicant's design represents a departure from presently known staple removers. Rather than "clawing" staples from papers, such as is done with removers typified by the above-referenced Augustin remover, Applicant's remover pries open the cusps of a staple as it simply lifts the staple from the paper.

Applicant's remover also represents an improvement over removers which consist of nothing but a pry bar (exemplified by the remover of Goldy, Des. U.S. Pat. No. 258,863). Like a pry bar remover such as Goldy, Applicant's remover does involve a pry bar which slides under the cross member portion of an installed staple. However, unlike such prior art removers, Applicant's remover does not rely on simply prying the staple from the paper with the pry bar, and thereby often tearing the paper in the process. Applicant's remover, in effect, has a two-piece pry bar. One part remains in contact with the paper's surface, while a movable lifting tab lifts the staple from the paper surface level. The paper is not possibly damaged through proper use of Applicant's remover because, as the staple is pulled from the paper by the lifting tab, the staple is drawn past the pry bar (which is only slightly narrower than the width of the staple cross member and remains at the paper surface lever) thereby straightening the cusps of the staple as the staple is pulled by the edges of the pry bar, and drawing the cusps directly through the holes in the paper which were formed as the staple was installed.

Applicant's remover also exhibits a staple trap in which a magnet is installed. The magnet trap is positioned for catching staples as they "pop" from the paper's surface and for retaining them until the trap is emptied.

The pry bar and lifting tab portions of Applicant's remover are borne by members which pivot in a scissor-like manner and which have palm and thumb actuator structures for single-handed operation of the remover.

There is virtually no chance of damaging a paper through proper use of Applicant's remover.

BRIEF DESCRIPTION OF THE DRAWINGS

Applicant's invention may be further understood from a description of the accompanying drawings wherein, unless otherwise specified, like reference numbers are intended to depict like components in the various views.

DETAILED DESCRIPTION OF THE PREFERRED EMBODIMENT

Figure 1:
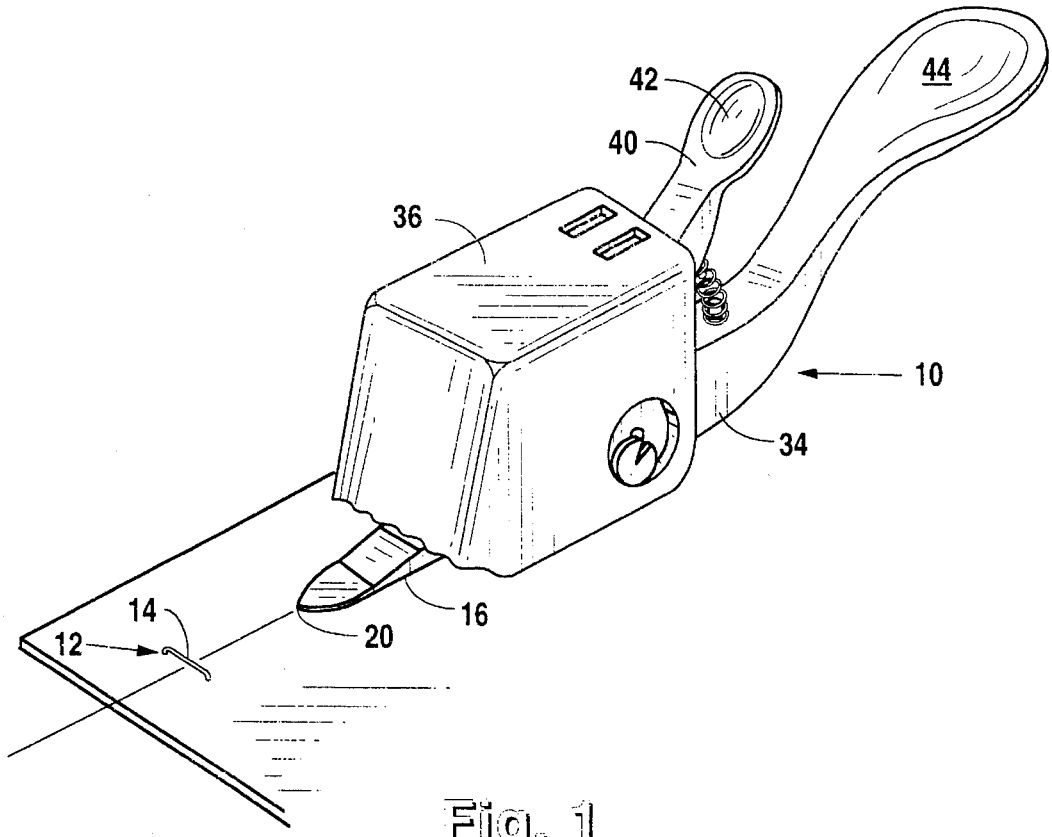
FIG. 1 is a perspective view of the preferred embodiment of Applicant' staple remover.
Figure 4:
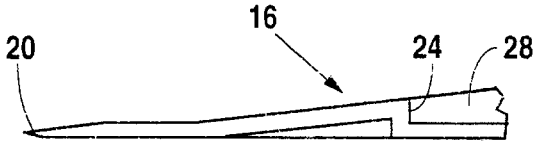
FIG. 4 is an elevational side view of the pry bar portion of Applicant's staple remover.

Referring to FIG. 1, Applicant's staple remover is identified generally by the reference numeral 10. The staple shown in FIG. 1 is identified as 12, with the cross member thereof being referenced as 14.

Figure 2:
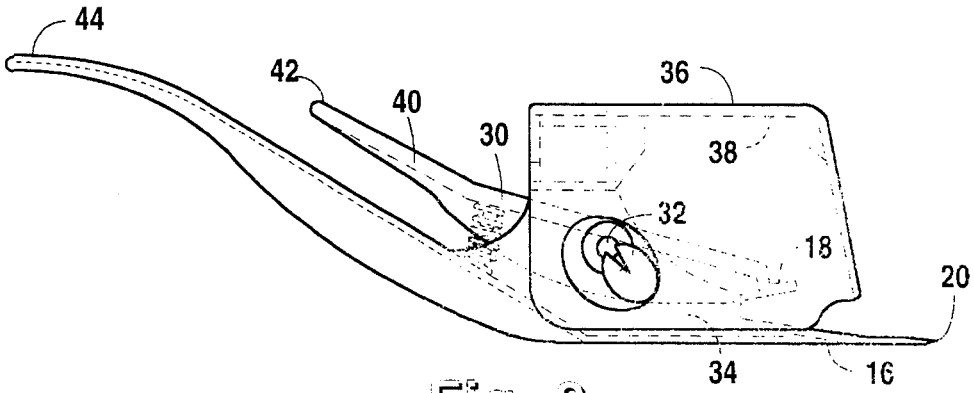
FIG. 2 is an elevational, schematic right side view of the preferred embodiment.
Figure 3:
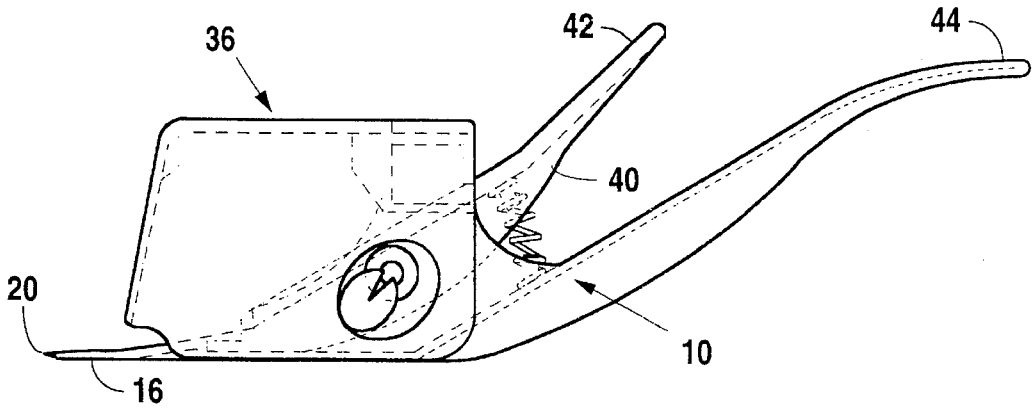
FIG. 3 is an elevational, schematic left side view of the preferred embodiment.
Figure 5:
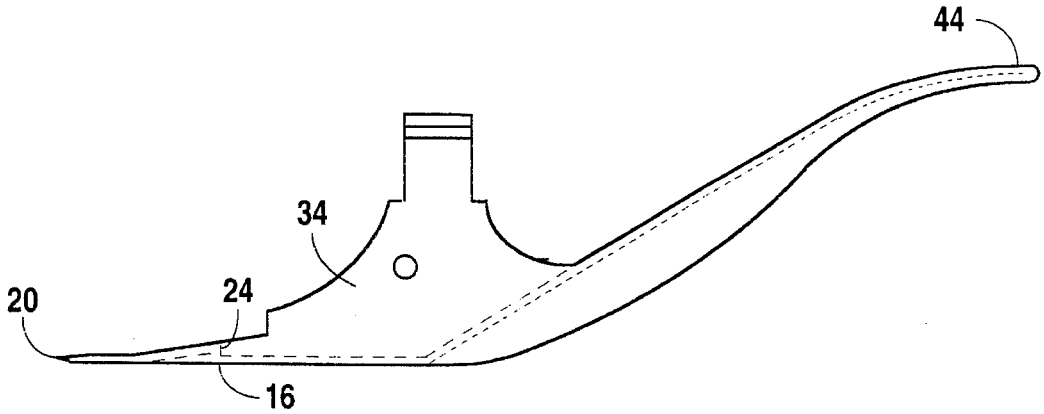
FIG. 5 is an elevational side view of the pry bar support housing of the preferred embodiment.
Figure 6:
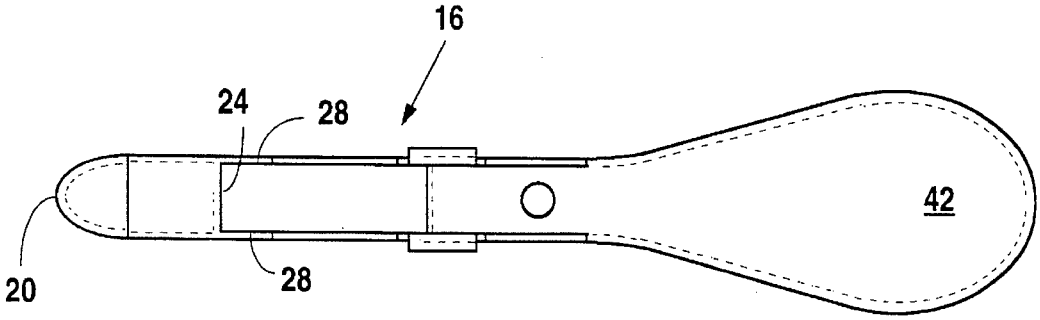
FIG. 6 is a top plan view of the pry bar support housing of the preferred embodiment.

Referring to FIGS. 1, 2, 3, and the primary components of Applicant's staple remover 10 are the pry bar 16 and the lifting tab 18. Pry bar 16 is configured whereby it has an insertion tip 20 which is pointed and slender. Insertion tip 20 is designed to easily slide under a staple cross member 14 between the cross member 14 and the underlying paper 22.

Moving rearward from the insertion tip 20, pry bar 16 gradually increases in thickness. At a point slightly less than one inch from the insertion tip 20, pry bar 16 exhibits a recess 24 which is bounded on either longitudinal side 26 of pry bar 16 by rails 28. The upper surface of rails 28 are contoured relative to the bottom surface of the pry bar 16 whereby they extend along the same slope as the non-recessed, more forward portion of pry bar 16.

Recess 24 is the surface feature of pry bar 16 with which lifting tab 18 mates between and in the first stages of staple lifting operations. Upon full insertion of staple remover 10 during a staple removing operation, staple cross member 14 will come to overlie lifting tab 18 as pry bar 16 progressively passes under staple cross member 14. Actuating lifting tab 18 (as will be described, along with the involved mechanical elements, later herein) lifts the staple from the paper 22, with the pry bar forcing the staple cusps (not shown in the drawings) to straighten and release their grip on the paper 22 as the staple is drawn therefrom.

Referring in combination to FIGS. 2, 3, 4 and 6, lifting tab 18 is situated at one end of a pivot arm 30. Pivot arm 30 pivots on an axil member 32 which, in turn, is supported by a pry bar support housing 34. Pivot arm 30 is configured and positioned relative to pry bar support housing 34 whereby lifting tab 18 moves between a pre-lift position (such as depicted in FIG. 3) wherein lifting tab 18 is fully nested within the bounds of recess 24 and a post-lift position (such as depicted in FIG. 2).

Referring in combination to FIGS. 1, 2, and 3, a staple trap 36 is, in the preferred embodiment, attached to pry bar support housing 34. Staple trap 36 is a shroud-like structure which over-lies and opens toward the upper face of the rearward portion of pry bar 16 which exhibits recess 24. A magnet 38 is positioned inside the staple trap 36 on the uppermost surface or "ceiling" of the staple trap 36. The magnet serves to "catch" staples as they are propelled into the staple trap 36 through action of the lifting tab 18, and to collect such staples for later removal and discarding at an appropriate and convenient time.

While the components which are directly responsible for operation of staple remover 10 have been discussed thus far, features which enhance the ease of operation, or merely define the most desirable mode of Applicant's invention will now be described.

The rearward portion of staple trap 36 includes an opening (not visible in the present drawings) through which an actuating lever 40 of pivot arm 30 extends for operation of pivot arm 30 and the resulting movement of lifting tab 18. The rearward-most portion of the actuating lever 40 is fashioned into a thumb tab 42. The rearward-most portion of pry bar support housing 34 is formed into a palm handle 44. The thumb tab 42 and palm handle 44 are provided to facilitate single-handed operation of staple remover 10.

Although the invention has been described with reference to specific embodiments, this description is not meant to be construed in a limited sense. Various modifications of the disclosed embodiments, as well as alternative embodiments of the inventions will become apparent to persons skilled in the art upon the reference to the description of the invention. It is, therefore, contemplated that the appended claims will cover such modifications that fall within the scope of the invention.

I claim:

1. A staple removing apparatus comprising:

a pry bar having an upper face and a lower face, said upper face being tapered from a thin distal tip portion to a thicker medial section, lateral margins of said upper face of said pry bar between said distal tip and said medial section defining a substantially continuously rising contour relative to said lower face which lower face is substantially planer, said upper face in said medial section exhibiting a recess;

a lifting tab sized and shaped to nest within said recess, said lifting tab being movably supported by lifting tab support means whereby said lifting tab moves between a first pre-lifting position wherein said lifting tab is nested in said recess, and a second post-lifting position wherein said lifting tab is positioned to overlie said pry bar;

magnetic staple trap means positioned relative to said pry bar and said lifting tab for intercepting and magnetically trapping staples propelled from, and through cooperative action of, said pry bar and said lifting tab.

2. The invention of claim 1 wherein said magnetic staple trap means is a magnetized member spatially separated from said pry bar and said lifting tab in a direction toward which said lifting tab moves when moving from said first pre-lifting position to said second post-lifting position.

3. The invention of claim 2 wherein said magnetized member exhibits a substantially planer face oriented toward said pry bar and said lifting tab and housed within a shroud member which is removably attached to said pry bar.

* * * * *